US010651548B2

(12) United States Patent
Kaneko et al.

(10) Patent No.: US 10,651,548 B2
(45) Date of Patent: May 12, 2020

(54) SUBSTRATE ANTENNA

(71) Applicant: NISSEI Limited, Tokyo (JP)

(72) Inventors: Tsutomu Kaneko, Tokyo (JP); Takahisa Karakama, Nagano (JP)

(73) Assignee: NISSEI LIMITED, Tokyo (JP)

( * ) Notice: Subject to any disclaimer, the term of this patent is extended or adjusted under 35 U.S.C. 154(b) by 254 days.

(21) Appl. No.: 15/627,483

(22) Filed: Jun. 20, 2017

(65) Prior Publication Data

US 2017/0365918 A1 Dec. 21, 2017

(30) Foreign Application Priority Data

Jun. 21, 2016 (JP) ..... 2016-122365

(51) Int. Cl.

| | |
|---|---|
| ***H01Q 1/38*** | (2006.01) |
| ***H01Q 21/28*** | (2006.01) |
| ***H01Q 1/52*** | (2006.01) |
| ***H01Q 3/12*** | (2006.01) |
| ***H01Q 9/27*** | (2006.01) |
| ***H01Q 25/00*** | (2006.01) |

(52) U.S. Cl.

CPC ..... *H01Q 1/38* (2013.01); *H01Q 1/523* (2013.01); *H01Q 3/12* (2013.01); *H01Q 9/27* (2013.01); *H01Q 21/28* (2013.01); *H01Q 25/00* (2013.01)

(58) Field of Classification Search

CPC .. H01Q 1/36; H01Q 1/38; H01Q 1/52–1/525; H01Q 9/27

See application file for complete search history.

(56) References Cited

U.S. PATENT DOCUMENTS

| | | | | |
|---|---|---|---|---|
| 7,079,079 | B2 * | 7/2006 | Jo | H01Q 1/243 343/700 MS |
| 8,570,223 | B2 * | 10/2013 | Arslan | H01Q 1/38 343/700 MS |
| 2004/0056823 | A1 * | 3/2004 | Zuk | G06K 19/07749 343/895 |
| 2008/0231541 | A1 * | 9/2008 | Teshirogi | H01Q 1/3233 343/895 |
| 2011/0037673 | A1 * | 2/2011 | Huang | H01Q 5/00 343/793 |

FOREIGN PATENT DOCUMENTS

| | | |
|---|---|---|
| JP | 2007-142666 A | 6/2007 |
| JP | 2016-19018 A | 2/2016 |

* cited by examiner

*Primary Examiner* — Dameon E Levi
*Assistant Examiner* — Hasan Z Islam
(74) *Attorney, Agent, or Firm* — Mattingly & Malur, PC

(57) ABSTRACT

A substrate type antenna for conducting signal transmitting/receiving using two (2) antennas, each having almost a same resonance frequency band, wherein each of the two (2) antennas applies therein a spiral antenna having an antenna side coupling pattern, which is positioned to face to a power supply point side coupling pattern, and a spiral antenna having a spiral antenna pattern, which is coupled to the antenna side coupling pattern, and wherein those two (2) antennas are positioned in such a manner that extending directions of the facing end portions, being closest to each other in the spiral antenna patterns of those two (2) antennas, are not aligned to each other, but are shifted in different directions.

5 Claims, 8 Drawing Sheets

SUBSTRATE ANTENNA

TECHNICAL FIELD OF THE INVENTION

The present invention relates to a substrate type antenna including two (2) antennas, each having a resonance frequency band being almost same to.

BACKGROUND OF THE INVENTION

Such as in case of MIMO communication (Multi Input Multi Output) is already known structure of arranging two (2) or more antennas neighboring with each other, and thereby achieving high-speed communication. As a substrate type antenna according to the conventional art is already known that having a substrate made of dielectric material, a loop-shaped first coupling pattern formed on one of the surfaces of this substrate, being cut off in apart thereof, and a loop-shaped second coupling pattern formed on the other surface of the substrate, being cut off in a part thereof, and also connecting the respective power supply points to the both ends, which are divided, wherein couplings of dielectric coupling and magnetic inductive coupling are made between the first coupling pattern and the second coupling pattern, while connecting the antenna at one end of the first coupling pattern (please see Patent Document 1, for example).

Also, in the substrate type antenna for achieving the MIMO communication with using the plural numbers of antennas, there is also already known substrate type antenna, being characterized that the plural number of antennas apply the first substrate type antenna, which is configured to have a linear polarization type, and the second substrate type antenna, which is configured to apply a spiral type antenna, having the resonance frequency band being almost same to that of the first antenna, but not the linear polarization type (please see Patent Document 2, for example).

PRIOR ART DOCUMENTS

Patent Documents

[Patent Document 1] Japanese Patent Laying-Open No. 2007-142666 (2007); and

[Patent Document 2] Japanese Patent Laying-Open No. 2016-19018 (2016).

BRIEF SUMMARY OF THE INVENTION

However, in the case where the MIMO communication is achieved by using the substrate type antenna, if applying such two (2) pieces of substrate type antennas of the linear polarization type therein, as is described in the Patent Document 1, an interference occurs, in particular when both the antennas are arranged to be close to or neighboring with each other, i.e., a matching frequency being shifted. Also, in the case of applying the first substrate type antenna, which is constructed with such linear polarization antenna, and the second substrate type antenna, which is constructed with the spiral type antenna, not being the linear polarization antenna, it is said that both antennas can be positioned to be close to each other, in the vicinity of 30 to 24 mm; however, the size of the substrate is enlarged when the specific measurement is kept, and therefore minimizing the space between the antennas to small-size the substrate is required.

An object of the present invention is to provide a substrate type antenna enabling to achieve small-sizing, much more, while preventing from the interference of shifting the resonance frequency even if disposing the two (2) antennas having almost the same resonance frequency to be close to or neighboring with each other.

For accomplishing the object mentioned above according to the present invention, there is provided a substrate type antenna for conducting signal transmitting/receiving with using two (2) antennas, each having almost the same resonance frequency, wherein each of those two (2) antennas applies therein a spiral antenna having an antenna side coupling pattern, which is positioned to face to a power supply point side coupling pattern, and a spiral antenna having a spiral antenna pattern, which is coupled to the antenna side coupling pattern, and wherein those two (2) antennas are positioned in such a manner that extending directions of the facing end portions, being closest to each other in the spiral antenna patterns of those two (2) antennas, are not aligned to each other, but shifted in different directions.

With such structure, it is possible to enable to dispose both of the two (2) antennas having almost the same resonance frequencies close to each other with preventing from occurring the interference between them, and thereby to obtain a more small-sized substrate type antenna.

Also, in addition to the structure mentioned above, according to the present invention, an angle to be shifted by rotating, on a substrate surface, on which one of the said spiral antenna patterns is formed, with respect to the other said spiral antenna patterns, is set to N×90 degrees (N: an integer), when shifting the facing end portions of said both spiral antenna patterns being closest to each other.

With such structure, it is possible to bring the direction of extending the facing end portions at closest to each other, into the direction almost facing thereto, and thereby disposing them to be close to each other while preventing the interference from occurring between the both of them, effectively.

Also, in addition to the structure mentioned above, according to the present invention, an angle to be shifted by rotating, on a substrate surface, on which one of the said spiral antenna patterns is formed, with respect to the other said spiral antenna patterns, is set at approximately 180 degrees, when shifting the closest facing end portions of said both spiral antenna patterns.

With such structure, it is possible to bring the direction of the extending closest facing end portions in the spiral antenna patterns, into the direction almost facing thereto, and also since both the spiral antenna patterns are almost same in the structures thereof, it is possible to disposing them to be close to each other with preventing the interference from occurring between both of them, effectively, but without deforming the structures of an environment and/or the configurations of the substrate.

Also, in addition to the structure mentioned above, according to the present invention, said two (2) spiral antenna patterns are disposed in parallel with, neighboring to each other on a common substrate, and one of said spiral antenna patterns neighboring with is disposed to be rotated on said substrate, thereby shifting said spiral antenna patterns to be closest to each other.

With such the structure, it is possible to obtain the small-sized substrate type antenna with protecting the interference from occurring between both of the antennas if disposing the spiral antenna patterns to be close to each other on the same substrate, concluding in using fewer numbers of substrates.

Also, in addition to the structure mentioned above, according to the present invention, while forming a pair of said pair of power supply point side coupling patterns, each having a gap on a first substrate surface, one of said pair of power supply point side coupling patterns is disposed to be shifted by rotating the other thereof on said first substrate surface, and while forming a pair of said antenna side coupling patterns, each having a gap on a second substrate surface, one of said pair of antenna side coupling patterns is disposed to be shifted by rotating the other thereof on said second substrate surface, and thereby disposing said pair of power supply point side coupling patterns and said pair of antenna side coupling patterns are disposed to face to, respectively.

With such the structure, it is possible to obtain the small-sized substrate type antenna, disposing the power supply point side coupler pattern and the antenna side coupler pattern of the two (2) antennas having the almost same resonance frequency, to be close to each other, with using the first substrate surface and the second substrate surface.

Also, in addition to the structure mentioned above, according to the present invention, each of said antenna side coupling patterns in said two (2) antennas, applying said spiral antennas therein, has multiple structures of being divided by a gap, respectively, and said spiral antenna pattern has multiple structures of combining with said each antenna side pattern of said portion divided by said each gap, respectively, as well as, circulating in a same direction so as to encloses said each gap.

With such the structure, it is possible to enhance the characteristics of enabling to dispose the two (2) antennas having the almost same resonance frequency to be close to each other, with preventing the interference from occurring between both of them, by adjusting the end positions and/or the length of each of spiral antenna patterns in the multiple structures.

Also, in addition to the structure mentioned above, according to the present invention, other antenna pattern having a resonance frequency band different from said resonance frequency band, on a third substrate surface, and said other antenna pattern is disposed at a position facing to said one of power supply point side coupling patterns.

With such the structure, it is possible to obtain a multi-band antenna structure, easily, by enhancing the structure of disposing the two (2) antennas having the almost same resonance frequency to be close to each other, and also by adding the antenna having the other resonance frequency, at the same time.

Also, in addition to the structure mentioned above, according to the present invention, said both spiral antenna patterns of said two (2) antenna are formed on the substrates different from, respectively, and said both substrates are disposed almost in parallel with, facing said both spiral antenna patterns to each other, so that winding directions of spiral on said both spiral antenna patterns in said both substrates are different from each other.

With such the structure, it is possible to dispose the two (2) antennas having the almost same resonance frequency while preventing the interference from occurring between both of them even if determining the distance between both of them to be narrower than that of the conventional art, thereby obtaining the small-sized substrate type antenna.

Further, in addition to the structure mentioned above, according to the present invention, it is characterized that a spacer made of a dielectric material is interposed between said both substrates.

With such the structure, it is possible to keep the distance of holding the distance between both of the substrates disposed facing to each other, which is determined in the manner mentioned above, by means of the spacer, and also to take isolation by means of the spacer made of the dielectric material, even if bringing the substantial distance between the antenna patterns to be smaller.

Effect of the Invention

With the substrate type antenna, in accordance with the present invention, it can be constructed to be small in the size thereof, while preventing the resonance frequency between the two (2) antennas, having the almost same resonance frequency, from being shifted due to the interference between them, even if the spiral antenna patterns are disposed to be close to each other.

DETAILED DESCRIPTION OF THE PREFERRED EMBODIMENTS

Hereinafter, explanation will be made on the present invention with referring to the attached drawings.

Embodiment 1

The substrate type antenna according to the present embodiment, to be structured for use in the MIMO communication of the 800 MH band, comprises a main antenna, including a first antenna for use of LTE communication and an antenna for use of GPS, and also a sub-antenna. The first antenna is used as an antenna for transmitting/receiving a single of a resonance frequency band of 815-875 MHz, while the sub-antenna is used for receiving a signal of resonance frequency band of 815-875 MHz.

Figure 1:
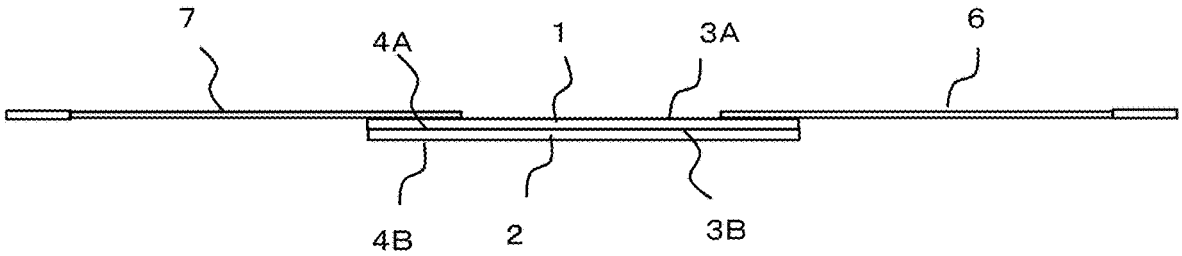
FIG. 1 is a side view for showing the substrate type antenna, according to an embodiment of the present invention.

FIG. 1 is a side view for showing the substrate type antenna, according to the embodiment of the present invention.

Two (2) pieces of substrates 1 and 2 are piled up or laminated, wherein a substrate surface 3A is formed on the side of an upper surface of the substrate 1, while a substrate surface 3B is formed on the side of a lower surface of the substrate 1. In the similar manner, on the side of the upper surface of the substrate 2 is formed a substrate surface 4A, while on the side of the lower surface of the substrate 2 is formed a substrate surface 4B. On the substrate surface 3A are formed a first power supply point side coupling pattern of a first antenna, i.e., a main antenna, and also a second power supply point side coupling pattern of a second antenna, i.e., a sub-antenna, the details of which will be mentioned later, wherein an end of a transmitting/receiving cable 6 is connected to the first power supply point side coupling pattern, while an end of a receiving cable 7 is connected to the second power supply point side coupling pattern.

Figure 2:
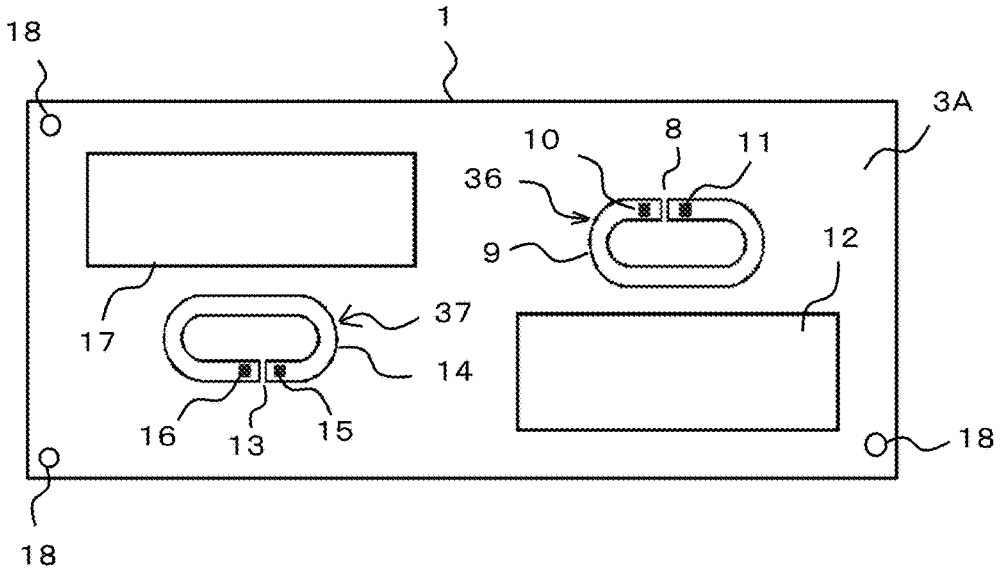
FIG. 2 is an enlarged plane view for showing power supply point-side patterns on the substrate type antenna shown in FIG. 1.

FIG. 2 is an enlarged plane view for showing the first substrate surface 3A.

The substrate 1 for forming the first substrate surface 3A has sizes, height of 35 mm, width of 70 mm, and depth 0.4 mm, approximately, for example. In a region on the right side of the first substrate surface 3A, there are formed a loop-shaped power supply point coupling pattern 9, which is divided in a part thereof by a gap 8 formed in an upper side shown in the figure, a power supply point 10 and an earth point 11, which are formed on both of the divided end portions of this power supply point coupling pattern 9, and a power supply point-side pattern 36, which is made of an earth portion pattern 12 at the earth potential, for stabilizing the potential given to the power supply point 10. To the power supply point 10 and the earth point 11 are connected the transmitting/receiving cable 6 shown in FIG. 1.

On the other hand, in a region on the left side of the substrate surface 3A, there are formed a loop-shaped power supply point side coupling pattern 14, which is divided in a part thereof by a gap 13 formed in a lower side shown in the figure, a power supply point 15 and an earth point 16, which are formed on the both divided end portions of this power supply point-side coupling pattern 14, and a power supply point-side pattern 37, which is provided with an earth portion pattern 17 at the earth potential, for stabilizing the potential given to the power supply point 15. To the power supply point 15 and the earth point 16 are connected the receiving cable 7 shown in FIG. 1.

When comparing the power supply point-side pattern 36 of the right side region and the power supply point-side pattern 37 of the left side region, on the substrate surface 3A, the power supply point-side pattern 37 of the left side region takes such a configuration obtained by rotating the power supply point-side pattern 36 in the right side region on the substrate surface 3A by 180 degree. Also, holes 18 for mounting the substrate 1 are formed or opened in an upper portion and a lower portion on the left side, and also, an upper portion and a lower portion on the right side, among those formed at four corners of the substrate 1, respectively. Although illustration thereof is omitted here, however, no such patterns as of the substrate surface 3A is formed on the substrate surface 3B, on the lower side of the substrate 1.

Figure 3:
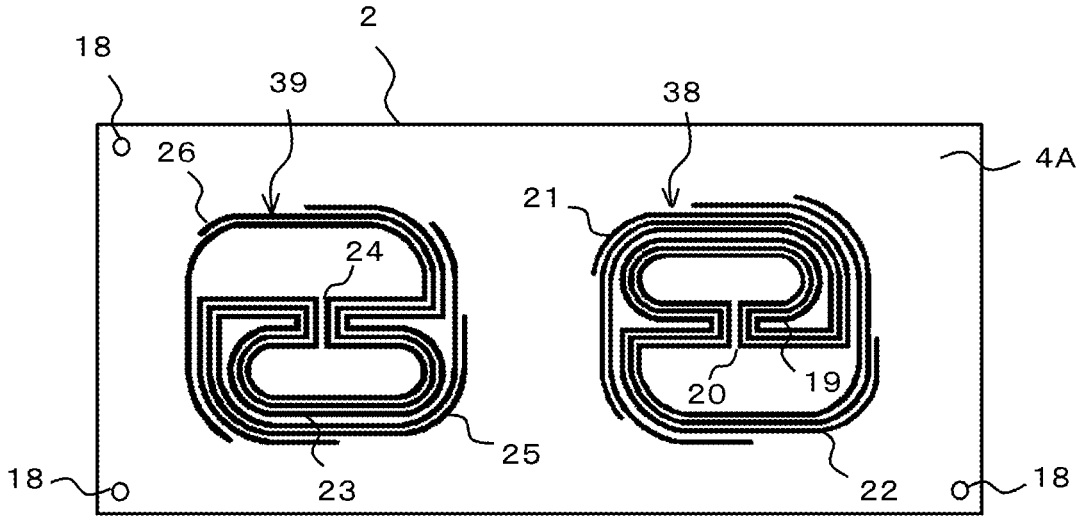
FIG. 3 is an enlarged plane view for showing antenna patterns on the substrate type antenna shown in FIG. 1.

FIG. 3 is an enlarged plane view for showing the substrate surface 4A.

In the right side region 4A on the substrate 2, there is formed a first antenna pattern 38 comprising a triplicated first antenna-side coupling pattern 19, which is disposed facing to the power supply point-side coupler pattern 9 shown in FIG. 2 in the laminating direction thereof and is also shaped in almost "C"-like, a gap 20, which divides the first antenna-side coupler patterns 19 at the portion of the lower side in the figure, and a triplicated spiral antenna patterns 21 and 22, each of which is coupled with the portions divided by this gap 20, respectively, and encloses the gap 20 while centering around it in the counter-clockwise direction, approximately.

The first antenna-side coupling pattern 19, although being formed at the position facing to the power supply point-side coupling pattern 9 shown in FIG. 2, in the laminating direction thereof, is formed at the position being shifted from the gap 8 and/or the gap 20 without facing thereto in the laminating direction. Also, each of the spiral antenna patterns 21 and 22 mentioned above has an almost squire outer configuration, and applies Archimedes spiral or the like to a curved portion formed at every four corner thereof. Also, each of the triplicated spiral antenna patterns 21 and 22 has such structure that it can have desired frequency characteristics, respectively, by adjusting the position of the end portion and the length thereof, appropriately, i.e., matching can be made on it easily.

On the other hand, in a left-side region of the substrate surface on the substrate 2, there is formed a second antenna pattern 39 comprising a triplicated second antenna-side connector portion 23, which is disposed at the position facing to the power supply point-side coupling pattern 14 shown in FIG. 2 in the laminating direction and also formed in the almost "C" like shape, a gap 24, which divides the second antenna-side connector portion 23 at the upper side position shown in the figure, and triplicated antennas 25 and 26, each of which is coupled to portions divided by this gap 24 and encloses the gap 24 while centering around it in the anti-clockwise direction, approximately.

Although the second antenna-side connector portion 23 is disposed at the position facing to the power supply point-side coupling pattern 14 shown in FIG. 2 in the laminating direction, however, the gap 13 and the gap 14 are formed at the positions shifted with, not facing to each other in the laminating direction. Also, each of the spiral antenna patterns 25 and 26 mentioned above has an almost squire outer configuration, and applies Archimedes spiral or the like to a curved portion formed at every four corner thereof. Also, each of the triplicated spiral antenna patterns 25 and 26 has such structure that it can have desired frequency characteristics, respectively, by adjusting the position of the end portion and the length thereof, appropriately, i.e., matching can be made on it easily.

The first antenna, i.e., a main antenna, and the second antenna, i.e., a sub-antenna have almost same resonance frequency band, and are similar to each other in the basic structures and configurations thereof, i.e., the power supply point-side coupling pattern is facing to the first antenna pattern. However, comparing between the second antenna pattern 39 in the left-side region on the first substrate surface 4A of the substrate 2 and the first antenna pattern 38 in the right-side region thereof, the second antenna pattern 39 in the left-side region is disposed in the configuration in such a manner that the first antenna pattern 38 in the right-side region is rotated by 180 degrees on the first substrate surface 4A. For this reason, a facing side end portion of the spiral antenna 21, where the both antenna patterns 38 and 39 come to be closest to each other, differs in the structures thereof, from the facing side end portion of the spiral antenna pattern 25. In other words, the facing side end portion of the spiral antenna pattern 21 extends, mainly, from an upper to a lower in the figure, and contrary to this, the facing side end portion of the spiral antenna pattern 25 extends, mainly, from the lower to the upper in the figure, i.e., they are shifted by 180 degrees in the directions of the end portions.

Also, in upper and lower portions of the left-side and upper and lower portions of the right-side among four (4) corners of the substrate 2, there are formed the substrate mounting holes 18, respectively, at the positions corresponding to the substrate mounting holes 18 shown in FIG. 2.

Figure 4:
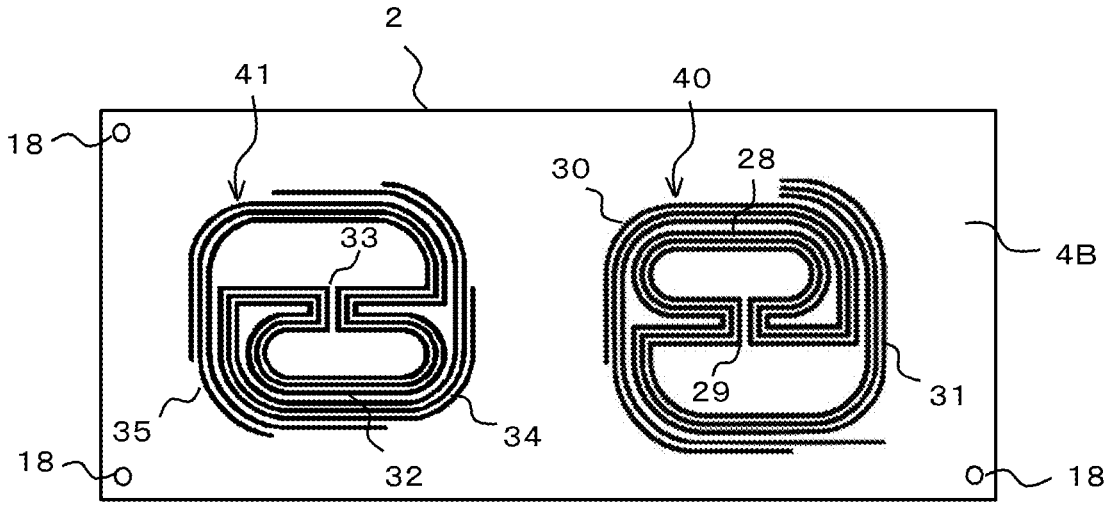
FIG. 4 is an enlarged view of other antenna patterns on the substrate type antenna shown in FIG. 1 seen from the above.

FIG. 4 is an enlarged view of the substrate surface 4B seen from an upper surface side thereof.

In a left-side region of the substrate surface 4B on the substrate 2, seen from the surface side thereof, there is formed a GPS antenna pattern 40, comprising a triplicated GPS antenna-side coupler pattern 28, which is disposed facing to the power supply point-side coupler pattern 9 shown in FIG. 2 in the laminating direction and is also shaped almost "C"-like, a gap 29, which divides a lower portion of the GPS antenna-side coupler pattern 28 shown in the figure, and triplicated spiral antenna patterns 30 and 31, each of which is coupled to portions divided by this gap 29, respectively, and encloses or envelopes the gap 29 while centering around it in the anti-clockwise direction, approximately.

The triplicated spiral antenna patterns 30 and 31, also, apply the Archimedes spiral or the like to the curved portions thereof, for example, in the similar manner to the case of each spiral antenna shown in FIG. 3. Each of those triplicated spiral antenna patterns 30 and 31, also has such structure that it can have desired frequency characteristics, respectively, by adjusting the position of the end portion and the length thereof, appropriately, i.e., matching can be made on it easily.

On the other hand, in the left-side region of the substrate surface 4B, there is formed a second auxiliary antenna pattern 41, comprising a triplicated antenna-side coupler pattern 32, which is disposed facing to the power supply pint-side coupler pattern 14 shown in FIG. 2 in the laminating direction and is also shaped almost "C"-like, a gap 33, which divides an upper portion of the antenna-side coupler pattern 32 shown in the figure, and triplicated spiral antenna patterns 34 and 35, each of which is coupled to portions divided by this gap 33, respectively, and encloses or envelopes the gap 33 while centering around it in the anti-clockwise direction, approximately.

Both the second antenna pattern 39, being configured in the left-side region on the substrate surface 4A shown in FIG. 3, and the second auxiliary antenna pattern 41, being configured in the left-side region on the substrate surface 4B shown in FIG. 4, make up a second antenna that operates cooperating with, so that a high gain can be obtained on the second antenna. However, it is also possible to omit the configuration of the second auxiliary antenna pattern 41 in the left-side region of the substrate surface 4B, which is shown in FIG. 3.

The substrate 1 and the substrate 2 mentioned above are laminated, and are positioned in such a manner that the respective substrate mounting holes 18 are aligned with in the laminating direction, and then they are bonded with. Then, the power supply point-side coupler pattern 9 and the first antenna-side coupling pattern 19 are coupled with, through the electrostatic capacity and the magnetic induction between them. And the power supply point-side coupler pattern 14 and the second antenna-side coupling pattern 23 and the antenna-side coupling pattern 32 are also coupled with, through the electrostatic capacity and the magnetic induction between them. Also, between the power supply point-side coupler pattern 9 and the GPS antenna-side coupler pattern 28, they are coupled with, through the electrostatic capacity and the magnetic induction between them, by means of the substrate 1 and the substrate 2. In this manner, it is possible to obtain transmitting/receiving signals of the first antenna and the GPS antenna, from the transmitting/receiving cable 6, and to obtain a receiving signal from the receiving cable 7.

Figure 5:
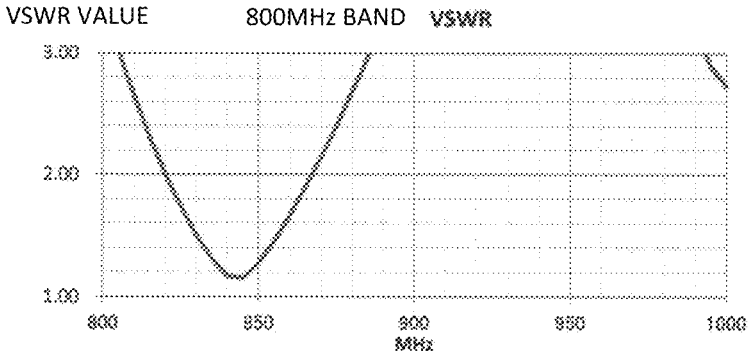
FIG. 5 is frequency characteristic curves of a VSWR value within a 800 MHz band of the main antenna in the substrate type antenna shown in FIG. 1.
Figure 6:
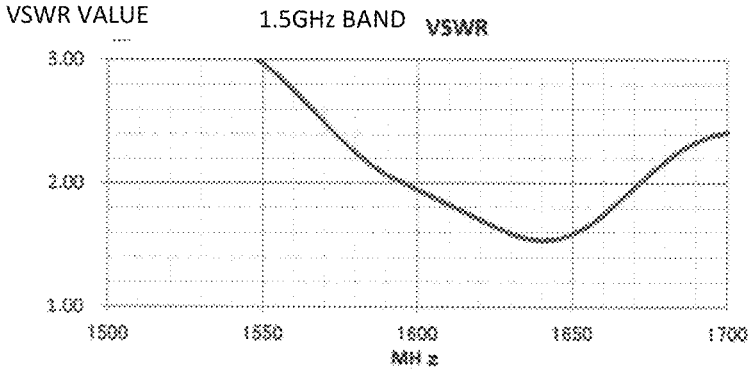
FIG. 6 is frequency characteristic curves of the VSWR value within a 1.5 GHz band of the main antenna in the substrate type antenna shown in FIG. 1.
Figure 7:
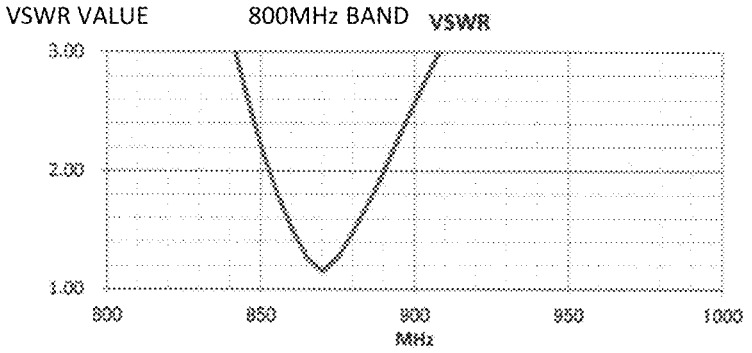
FIG. 7 is frequency characteristic curves of the VSWR value within the 800 MHz band of a sub-antenna in the substrate type antenna shown in FIG. 1.

FIGS. 5 to 7 show the frequency characteristics of the VSWR value of each antenna.

FIG. 5 shows the frequency characteristics of the VSWR value in 800 MHz band of the main antenna, FIG. 6 the frequency characteristics of the VSWR value in 1.5 GHz band of the main antenna, and FIG. 7 the frequency characteristics of the VSWR value in 800 MHz band of the sub-antenna, respectively.

Herein, the antenna for GPS has the resonance frequency band of 1.5 GHz, while other antenna, i.e., the first antenna, and the sub-antenna, i.e., the second antenna, have the resonance frequency band of 800 MHz, respectively. For this reason, the antenna for use of GPS may causes no problem of the interference between the other antenna(s). On the other hand, there maybe occurs a problem of the interference between the main antenna, i.e., the first antenna and the sub-antenna, i.e., the second antenna, because the resonance frequencies of those are in the same band of 800 MHz.

It was said that there is necessity of bringing the isolation between the first antenna and the second antenna to be equal to −10 dB or less than that, and in the conventional antenna configuration, the first antenna and the second antenna must be separated from, by the distance between them, so largely as it satisfies that condition, equal to −10 dB or less than that. Accordingly, if trying to build up a small-sized substrate type antenna without taking any countermeasures therein, i.e., disposing the first antenna pattern 38, constructing the first antenna as the main antenna, and the second antenna pattern 39, constructing the second antenna as the sub-antenna, to be close to each other, as is shown in FIG. 3, then the resonance frequencies thereof are instable due to the interference.

However, in case of disposing the first antenna and the second antenna to be close to each other, as is explained in FIG. 3, in particular, by taking a tip portion of the spiral antenna pattern 21 and a tip portion of the spiral antenna pattern 25 into the consideration, they are shifted from at the portions where they are facing to each other at the shortest distance, so that they are not entirely in the same direction. In the present embodiment, the second antenna pattern 39 in the left-side region is in a condition of rotating the first antenna pattern 38 in the right-side region by 180 degree on the substrate surface 4A. For this reason, a facing-side end portion of the spiral antenna pattern 21 extends, mainly, from the upper down to the lower in the figure, while on the contrary thereto, the facing-side end portion of the spiral antenna pattern 25 extends, mainly, from the lower to the upper in the figure; i.e., the facing-side end portions of the both extend in the completely reversed directions, respectively.

In this manner, by reversing the directions of extending the tip portion of the spiral antenna pattern 21 and the tip portion of the spiral antenna pattern, which are facing to at the shortest distance, it is possible to dispose those to be close to each other with preventing the interference from occurring between them, thereby to obtain the small-sized substrate type antenna. Also, since the spiral antennas 21 and 25 are almost same in the structures thereof because of having the almost same resonance frequency characteristics, and therefore, even if shifting the facing portions of the spiral antenna pattern 21 and the spiral antenna pattern 25, which are facing to each other at the shortest distance, by such the angle mentioned above, they can be disposed to be close to each other, while preventing the interference from occurring between both of them, effectively, and without changing the configuration of peripheral structures, such as, the earth patterns 12 and 17 and the substrate, etc., for example.

Such effects can be obtained, not only restricting to the case of applying the second antenna pattern in the condition of rotating the first antenna pattern 38 by 180 degree on the substrate surface 4A, but also by shifting the directions of extending the facing portions, which are close to each other at the shortest distance, by an angle of almost n×90 degree (n: an integer), while taking into the consideration the fact that 0 degree and 180 degrees do not means the shifting. Further, similar effects can be obtained by shifting the directions of extending the end portions of the first antenna and the second antenna, which are facing to each other at the shortest distance, not only restricting to the 90 degrees, but also by other angles.

Figure 8:
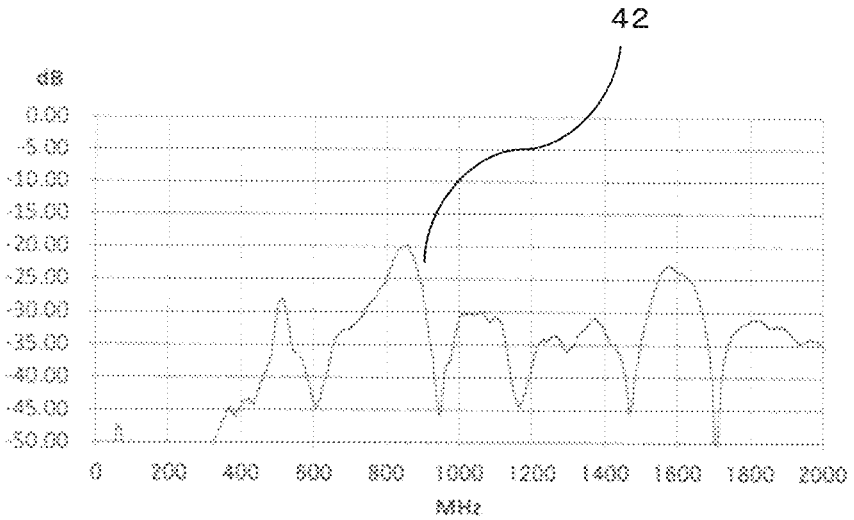
FIG. 8 is characteristic curves for showing a result of measurement of isolation between the main antenna and the sub-antenna in the substrate type antenna shown in FIG. 1.
Figure 9A:
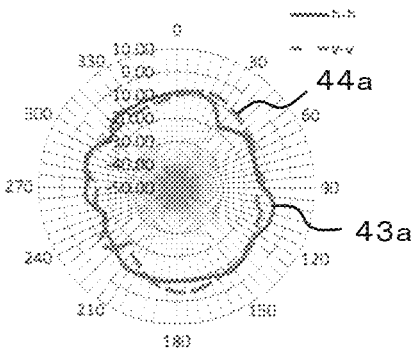
FIGS. 9A to 9D are radiation characteristic curves within the 800 MHz band of the main antenna in the substrate type antenna shown in FIG. 1.
Figure 9B:
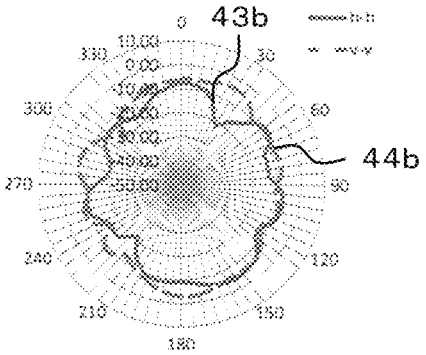
Figure 9C:
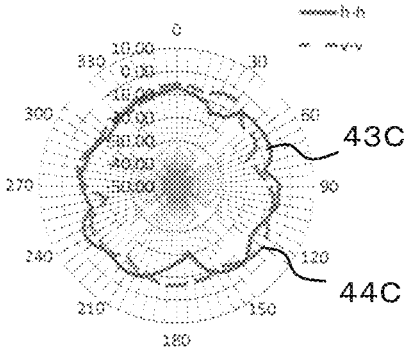
Figure 9D:
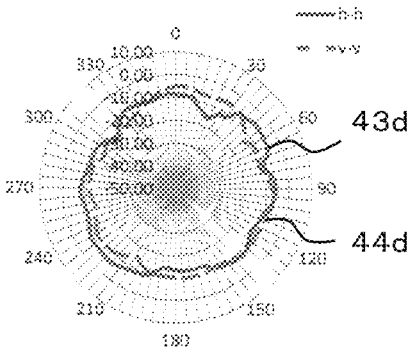

FIG. 8 is characteristic curves of showing measurement results 42 of isolation between the first antenna and the second antenna.

In this manner, as is shown in FIG. 8 showing the measurement results 42 of the isolation between the first antenna and the second antenna, it is possible to obtain stable frequency characteristics, in the desired embodiment, while preventing from the shifting of the resonance frequency due to the interference, even when approaching the shortest facing distance, between the spiral antenna pattern 21 and the spiral antenna pattern 25 shown in FIG. 3, down to 9 mm, with keeping the isolation between the first antenna and the second antenna to be −10 dB or lower than that.

FIG. 9 shows radiation characteristics on the main antenna.

FIG. 9(*a*) shows a horizontal direction gain 43*a* and a vertical direction gain 44*a* at the resonance frequency 815 MHz, in case of constructing the main antenna by the spiral antenna, wherein a peak value is −3.78 [dBi], a horizontal average value −9.99 [dBi], a vertical average value −9.66 [dBi], and an averaged gain −9.66 [dBi], respectively. FIG. 9(*b*) shows the horizontal direction gain 43*b* and the vertical direction gain 44*b* at the resonance frequency 830 MHz, wherein the peak value is −2.74 [dBi], the horizontal average value −9.96 [dBi], the vertical average value −7.14 [dBi], and the averaged gain −7.14 [dBi], respectively.

FIG. 9(*c*) shows the horizontal direction gain 43*c* and the vertical direction gain 44*c* at the resonance frequency 860 MHz, wherein the peak value is −4.14 [dBi], the horizontal average value −8.27 [dBi], the vertical average value −8.06 [dBi], and the averaged gain −8.06 [dBi], respectively. FIG. 9(*d*) shows the horizontal direction gain 43*d* and the vertical direction gain 44*d* at the resonance frequency 875 MHz, wherein the peak value is −4.93 [dBi], the horizontal average value −8.87 [dBi], the vertical average value −9.48 [dBi], and the averaged gain −8.87 [dBi], respectively.

Figure 10:
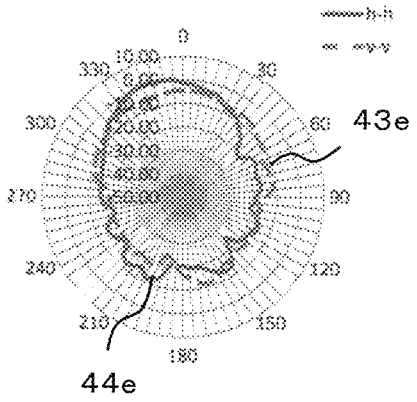
FIG. 10 is radiation characteristic curves within a GPS frequency of the main antenna in the substrate type antenna shown in FIG. 1.

FIG. 10 shows radiation characteristics on the antenna for use of GPS.

The same figure shows the horizontal direction gain 43*e* and the vertical direction gain 44*e* at the resonance frequency 1.57542 GHz, in case when constructing the antenna for use of GPS by the spiral antenna, wherein the peak value is −0.24 [dBi], the horizontal average value −7.86 [dBi], and the vertical average value −10.03 [dBi], respectively.

Figure 11A:
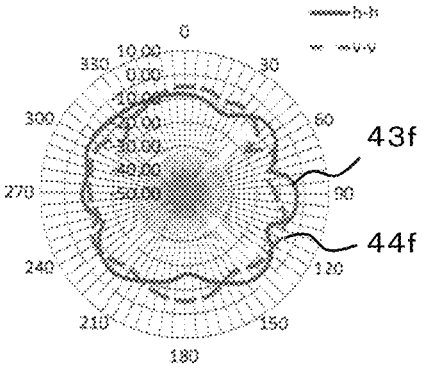
FIGS. 11A and 11B are radiation characteristic curves within the 800 MHz band of the sub-antenna in the substrate type antenna shown in FIG. 1.
Figure 11B:
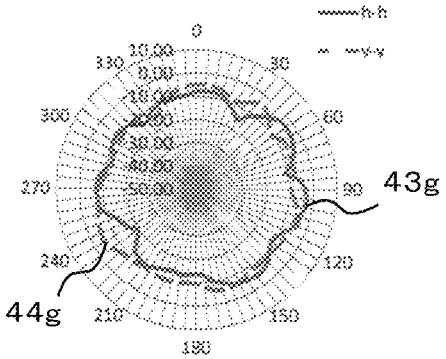

FIG. 11 shows radiation characteristics on the sub-antenna.

FIG. 11(*a*) shows the horizontal direction gain 43*f* and the vertical direction gain 44*f* at the resonance frequency 860 MHz, in case when constructing the sub-antenna by the spiral antenna, wherein the peak value is −3.17 [dBi], the horizontal average value −7.39 [dBi], the vertical average value −8.63 [dBi], and the averaged gain −7.39 [dBi], respectively. FIG. 11(*b*) shows the horizontal direction gain 43*f* and the vertical direction gain 44*f* at the resonance frequency 875 MHz, wherein the peak value is −2.83 [dBi], the horizontal average value −8.06 [dBi], the vertical average value −7.64 [dBi], and the averaged gain −7.64 [dBi], respectively.

As was mentioned above, even if constructing the main antenna and the sub antenna, each having the almost same resonance frequency band, to be close to each other in the mall-size, the main antenna, the antenna for use of GPS and the sub antenna, which are constructed by the spiral antennas, have inherent superior radiation characteristics, while preventing from the shifting of the resonance frequency due to the interference.

In this manner, it is possible to obtain the substrate type antenna having the small-size and the desired characteristics, even if the position of installing this kind of the substrate type antenna is a place where attenuation of a radio wave is relatively large, such as, in a metal case or the like, for example. Thus, it is possible to take the isolation in the small-sized structure, disposing the main antenna and the sub antenna to be close to each other, while preventing from the interference, and also to achieve a high gain of the main antenna, and a MIMO communication of a LTE communication method of 800 MHz band, with the multi-band structure thereof.

However, in the embodiment mentioned above, four (4) pieces of the substrate surfaces 3A to 4B are defined by applying two (2) pieces of the substrates 1 and 2, and among of those, each pattern is formed by applying three (3) pieces thereof, 3A, 4A and 4B; however, the present invention should not be restricted to this, it can be constructed by changing the number of pieces of the substrates and the number of the substrate surfaces, variously. Also, in the embodiment mentioned above, the explanation was given on the case of applying the antenna for use of GPS, but the main antenna and the sub antenna can be constructed, by replacing those by other antennas, which are to be used in the resonance frequency bands different from those.

Embodiment 2

Figure 12:
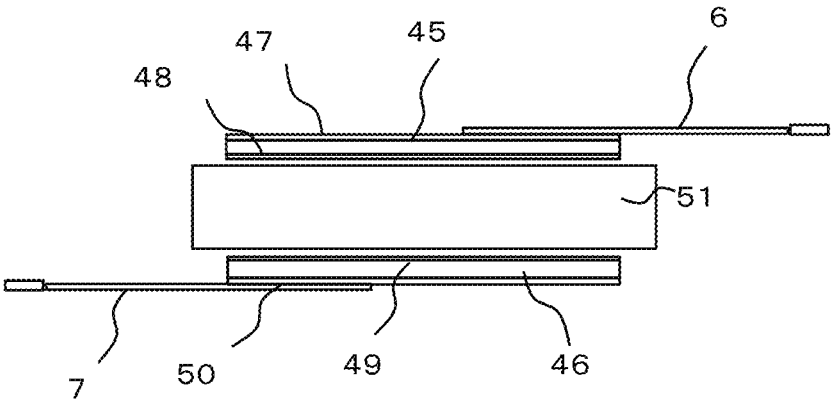
FIG. 12 is a side view for showing the substrate type antenna, according to other embodiment of the present invention.

FIG. 12 is a side view for showing the substrate type antenna according to other embodiment of the present invention.

Two (2) pieces of substrates 45 and 46, each having height of 35 mm, width of 35 mm, and thickness of 0.4 mm, approximately, are laminated. On an upper side surface of the substrate 45 is formed a substrate surface 47, and on a lower side surface of the substrate 45 is formed a substrate surface 48, respectively. Also, on an upper side surface of the substrate 46 is formed a substrate surface 49, and on a lower side surface of the substrate 46 is formed a substrate surface 50, respectively. Between the substrate surface 48 of the substrate 45 and the substrate surface 49 of the substrate 46 is arranged a spacer 51. Because of insertion of this, it is possible to shorten or reduce the distance between the antenna patterns.

Figure 13:
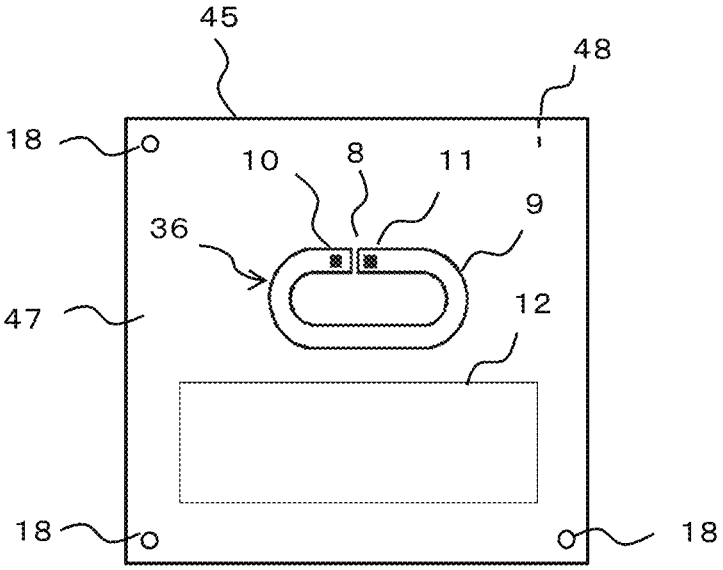
FIG. 13 is an enlarged plane view for showing power supply point-side patterns on one side in the substrate type antenna shown in FIG. 12.

FIG. 13 is a plane view for showing the enlarged substrate surface.

On the substrate surface 48 of the substrate 45 seen from the side of the substrate surface 47, there is formed the power supply point-side pattern 36 of the right side region shown in FIG. 3. The detailed structures of the first antenna pattern 38 are same to those shown in FIG. 3, and therefore, the detailed explanations thereof will be omitted herein, while attaching the same reference numerals to the equivalents thereof. With the power supply point 10 and the earth point 11 is connected the cable 6 for use of transmitting/receiving shown in FIG. 12.

Figure 14:
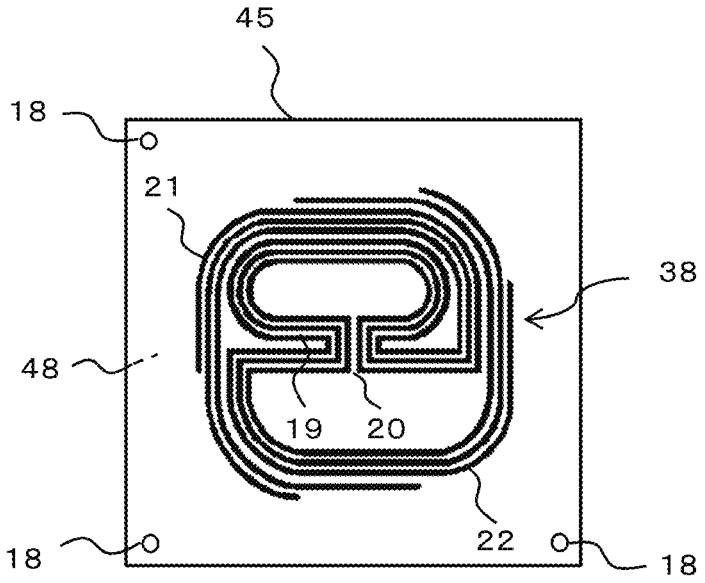
FIG. 14 is an enlarged view of the antenna patterns on the substrate type antenna shown in FIG. 12, seen from the side of the power point-side pattern.

FIG. 14 is an enlarged view of the substrate surface 48 seen from the side of the substrate surface 47.

On the substrate surface 48 of the substrate 45, seen from the side of the substrate surface 47, there is formed the first antenna pattern 38 shown in FIG. 3. The detailed structures of the second antenna pattern 39 are same to those shown in FIG. 3, and therefore, the detailed explanations thereof will be omitted herein, while attaching the same reference numerals to the equivalents thereof. Although a first antenna-side coupler pattern 19 almost corresponds to the power supply point-side coupler pattern 9 shown in FIG. 3, but the gap 8 shown in FIG. 13 lies in the upper side in the figure, i.e., being shifted into the position thereof, to an upper side, on the contrary to that the gap 20 is positioned in the lower side in the figure.

Figure 15:
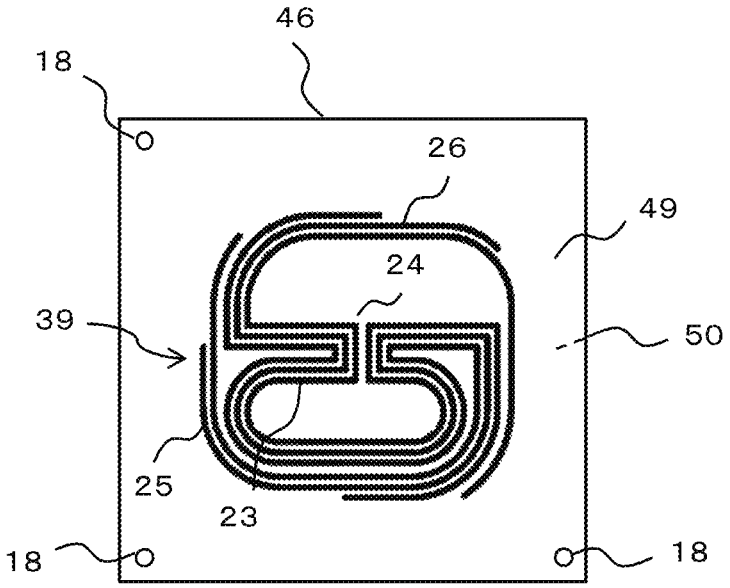
FIG. 15 is an enlarged view of the antenna patterns on the substrate type antenna shown in FIG. 12.

FIG. 15 is a plane view for showing the enlarged substrate surface 49.

On the substrate surface 49, i.e., the upper side surface of the substrate 46, there is formed the second antenna pattern 39 of the left-side region shown in FIG. 3. The detailed structures of the second antenna pattern 39 are same to those shown in FIG. 3, and therefore, the detailed explanations thereof will be omitted herein, but with attaching the same reference numerals to the equivalents thereof. As can be seen from comparison with the first antenna pattern 38 shown in FIG. 14, the substrate 48 and the substrate surface 49 are disposed to face to each other, in almost parallel relation with, in the assembling condition thereof, and define a portion where an entire of the facing portions of the both antenna patterns 38 and 39 comes to close to each other at the most. In this facing portion where they come close to at the most, rotating directions of the spiral antenna patterns 25 and 26 in the second antenna pattern are reversed to that of the spiral antennas in the first antenna pattern 38, and an extending direction in each end portion is reversed in the direction thereof, respectively.

Figure 16:
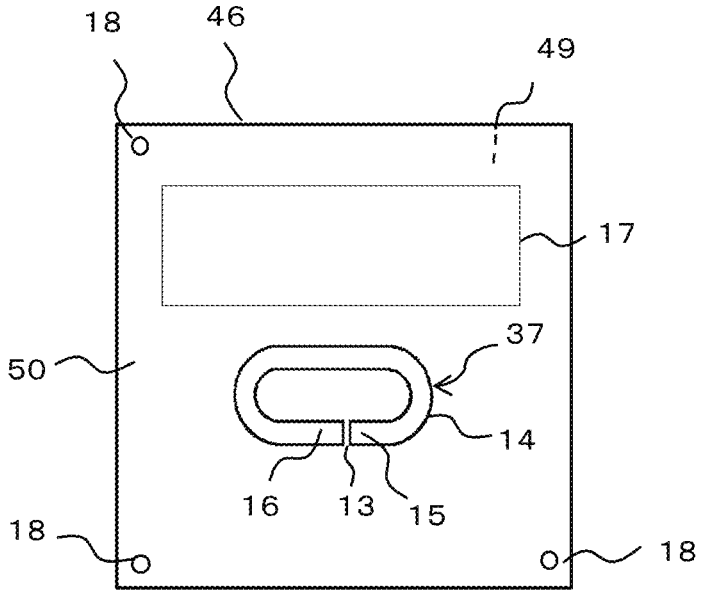
FIG. 16 is an enlarged view of the power supply point-side patterns on the substrate type antenna shown in FIG. 12, seen from the side of the antenna pattern.

FIG. 16 is an enlarged view of the substrate 50 seen from the side of the substrate surface 49.

On the substrate surface 50 formed on the lower side surface of the substrate 46, there is formed the power supply point-side pattern of the left-side region shown in FIG. 2. The detailed structures of the power supply pattern 37 are same to those shown in FIG. 2, and therefore, the detailed explanations thereof will be omitted herein, but with attaching the same reference numerals to the equivalents thereof. With the power supply point 15 and the earth point 16 is connected the cable for use of transmitting/receiving shown in FIG. 12.

The first antenna, i.e., the main antenna, and the second antenna, i.e., the sub antenna have the almost same resonance frequency bands, and are similar to each other in the basic structures and the configurations thereof, i.e., the power supply point-side pattern 36 and 37 and the antenna patterns 38 and 39 are facing to each other. However, on the substrate 45 of the first antenna is formed the power supply point-side pattern 36 on the substrate surface 47, which is formed on the upper side thereof, on the contrary to the above, on the substrate 46 of the second antenna is formed the power supply point-side pattern 37 on the opposite side, i.e., the lower side.

Therefore, the spiral antenna patterns 21 and 22 and the spiral antenna patterns 25 and 26, being disposed to face to each other, are disposed to face to and reversed in the rotating direction thereof, respectively, and also an entire of the each pattern defines the facing portion at the shortest distance. Thus, similar to the case of the previous embodiment(s), the end portions of the first antenna and the second antenna, facing to each other at the shortest distance, are shifted in the extending directions thereof, and thereby obtaining the similar effects.

In the present embodiment, the first antenna, i.e., the main antenna has the structure of forming the power supply point-side pattern 36 on the substrate surface 47, i.e., one of the substrate surfaces of the substrate 45, while forming the first antenna pattern 38 on the substrate surface 48, i.e., the reverse surface side thereof. And, the second antenna, i.e., the sub-antenna has also such the structure of forming the power supply point-side pattern 37 on the substrate surface 50, i.e., one of the substrate surfaces of 46, while forming the spiral antenna pattern 39 on the other substrate surface 49. Then, when laminating each of the substrates 45 and 46, they are arranged so that the substrate surface 47 of the substrate 45 faces to the substrate surface 49 of the substrate 46. For this reason, the circling or winding directions of each spiral antenna pattern in the first antenna pattern 38 and the second antenna pattern are reversed to each other.

With the structure of such the laminating method, it is possible to prevent the interference from occurring between first antenna and the second antenna, even if thinning the thickness of the spacer shown in FIG. 12 down to 15 mm, approximately, and thereby achieving the substrate type antenna being small-sized in the laminating direction. Also, comparing to the previous embodiment (S), it is possible to reduce each substrate in the width direction thereof. However herein, because the spacer 51 is made of the dielectric, preferably, the dielectric of material having higher dielectric constant, differing from the gap, it is possible to hold the substrate 45 and the substrate 46 by keeping a distance between them determined in the above, easily, with using the spacer 51. Applying the dielectric of the material having the higher dielectric constant, such as, the material or the dielectric having the dielectric constant or other dielectrics, same to the substrates 45 and 46, for example, it is possible to take or achieve isolation even if reducing the substantial distance between the antenna patterns less than 15 mm or much more.

In this way, disposing the facing end portions of each spiral antenna pattern, in the first antenna pattern 38 and the second antenna pattern 39, with shifting in such that they do not extend in the same direction in the relationship thereof, means to shift the phase of the transmitting/receiving signals, and therefore, it is possible to protect them from the interference of radio waves.

However, it is possible to select a number of pieces of the substrates to be used and/or which one of the front surface or the reverse surface of the substrate should be used, appropriately, and with such the configuration that the winding of each spiral antenna pattern is wound in the same direction and facing to each other, in the first antenna pattern 38 and the second antenna pattern 39, in the similar manner to that of the previous embodiment(s), they are shifted from so that the facing end portions thereof do not extend in the same direction in the relationship thereof. In other words, they are disposed with sifting from each other, so that the facing end portions do not extend in the same direction in the relationship thereof, by rotating them on the substrate surface, on which the each spiral antenna pattern is formed, by an angle of 90 degrees, or other angles obtained by multiplying it by an integer, in the first antenna pattern 38 or the second antenna pattern 39.

Further, in each of the embodiments mentioned above, the explanation was given on the substrate-type antenna for use of the MIMO communication; however, they can be used as a diversity antenna, by applying two (2) antennas having the totally same resonance frequency bands, applying one of them as a main antenna while applying the other as a sub-antenna. Also, the explanation was given on the antenna of 800 MHz band, but they can be applied to the substrate-type antennas of other frequency bands.

As was given in the above, the present invention is characterized, in the substrate-type antenna for conducting signal transmitting/receiving with using two (2) pieces of antennas having the almost same resonance frequency bands, wherein the two (2) pieces of antennas apply the spiral antennas, which have the antenna-side coupler patterns 19 and 23 being disposed to face to the power supply point-side coupler patterns 9 and 14, and the spiral antenna patterns 21, 22, 25 and 26 being coupled with the antenna-side coupler patterns 19 and 23, and are disposed with shifting, i.e., not extending the closest facing end portions of the spiral antenna patterns 21 and 25 of the two (2) pieces of antennas into the same direction.

With such the structure, it is possible to dispose the two (2) pieces of antennas to be close to each other while preventing the interference from occurring between those, both having the almost similar resonance frequency bands, thereby obtaining a small-size substrate-type antenna.

Also, according to the present invention, in addition to the structures mentioned above, it is characterized that, when shifting the facing end portions of the both spiral antenna patterns 21 and 25, the angle for shifting thereof, by rotting one of the spiral antenna patterns 21 or 25 with respect to the other of spiral antenna patterns 21 or 25, is set to 90 degrees or that obtained by multiplying it by integer.

With such the structure, it is possible to bring the directions of extending the closest facing end portions to be almost facing to each other, and it is possible to disposes them close to each other, with effectively preventing the interference from occurring between them.

Also, according to the present invention, in addition to the structures mentioned above, it is characterized that, when shifting the facing end portions of the both spiral antenna patterns 21 and 25, the angle for shifting thereof, by rotting one of the spiral antenna patterns 21 or 25 with respect to the other of spiral antenna patterns 21 or 25, is set to 180 degrees, approximately.

With such the structure, it is possible to bring the directions of extending the closest facing end portions to be almost facing to each other, and since the both spiral antenna patterns 21 and 25 are similar in the constructions thereof, then it is possible to disposes them close to each other, with more effectively preventing the interference from occurring between them, without necessity of changing the structures of the peripheral portions and/or the configuration of the substrate.

Also, according to the present invention, in addition to the structures mentioned above, it is characterized that the two (2) pieces of the spiral antenna patterns 21 and 25 are disposed neighboring with on the common substrate 2, and the one of the neighboring spiral antenna patterns 21 and 25 is disposed so that the other is rotated on the substrate 2, and thereby the closest facing end portions are shifted from.

With such the structure, it is possible to achieve a small-size substrate-type antenna, with using a small number of the substrates, while preventing the interference from occurring between the antennas even if the spiral antenna patterns 21 and 25 are disposed on the same substrate 2 close to each other.

Also, according to the present invention, in addition to the structures mentioned above, it is characterized that a pair of the power supply point-side coupler patterns 9 and 14 having the gaps 8 and 13 are formed on the first substrate surface 3A, and that one of the power supply point-side coupler patterns 9 and 14 is disposed to be shifted as the other is rotated on the second substrate surface 4A, and further that a pair of the power supply point-side patterns 36 and 37 and a pair of the antenna-side coupler patterns 19 and 23 are disposed, so as to face to each other respectively.

With such the structure, it is possible to achieve a small-size substrate-type antenna, wherein the power supply point-side coupler patterns 9 and 14 and the antenna-side coupler patterns 19 and 23 of the two (2) pieces of antennas, each having the almost same resonance frequency, are disposed to be close to each other, by using the first substrate surface 3A and the second substrate surface 4A.

Also, according to the present invention, in addition to the structures mentioned above, it is characterized that said each antenna-side coupler patterns 19 and 23 has a multiple structure of being divided by a gap, respectively, and that said each spiral antenna pattern is coupled with said each antenna-side coupler pattern of the portion, which is divided by said each gap, respectively, and further that it has a multiple structure of circling or winding them in the same direction so as to enclose said each gap.

With such the structure, while taking advantages that the two (2) pieces of antennas having the almost same resonance frequency characteristics can be disposed to be close with, while preventing the interference from occurring between the both of them, by adjusting the position and/or length of the end portions of each spiral antenna pattern having the multiple structure, it is possible to achieve matching, easily, in such that each can have a desired resonance frequency characteristic, respectively.

Also, according to the present invention, in addition to the structures mentioned above, it is characterized that the other antenna pattern of the resonance frequency band differing from said resonance frequency is disposed on the third substrate surface, and also that the other antenna pattern 40 is disposed at the position facing to the one of the power supply-side coupler patterns 9.

With such the structure, it is possible to obtain the multi-antenna structure, easily, at the same time, with making use of the structure of preventing the interference from occurring therefrom, while disposing two (2) pieces antennas having the almost same resonance frequency bands close to each other.

Also, according to the present invention, in addition to the structures mentioned above, it is characterized that the two (2) pieces of spiral antenna patterns 21 and 22 and 25 and 26 are formed on the different substrates 45 and 46, respectively, and the both substrates 45 and 46 are disposed almost in parallel with, facing to the spiral antenna patterns 21 and 22 and 25 and 26, and that the direction of winding of the spiral differs from each other in both the spiral patterns 21 and 22 and 25 and 26, on both of the substrates 45 and 46.

With such the structure, it is possible to dispose both the substrates 45 and 46 close to each other, while preventing from the interference between the two (2) pieces of antennas having the almost same resonance frequencies, even if narrowing the distance between those than that of the conventional art, with applying the smaller substrates 45 and 46, and thereby to obtain the small-size substrate type antenna.

Further, according to the present invention, in addition to the structures mentioned above, it is characterized that the spacer 51 made of the dielectric is put between the both substrates 45 and 46.

With such the structure, it is possible to hold the substrate 45 and the substrate 46 at the distance determined as was mentioned above, by means of the spacer 51, with ease, and further it is possible to obtain the isolation, even if narrowing the substantial distance between the antenna patterns, by means of the spacer, i.e., the dielectric.

What is claimed is:

1. A substrate antenna for conducting signal transmitting/receiving using a first antenna and a second antenna having a same resonance frequency band, wherein:

the first antenna includes:

a loop-shaped first power supply point-side coupling pattern which is divided in a portion thereof by a first gap;

a loop-shaped first antenna-side coupling pattern which is positioned to face the first power supply point-side coupling pattern in a laminating direction thereof and divided in a portion thereof by a second gap; and a first spiral antenna pattern having an approximately rectangular shape in a plan view and being coupled to the portion divided by the second gap, the second antenna includes:

a loop-shaped second power supply point-side coupling pattern which is divided in a portion thereof by a third gap;

a loop-shaped second antenna-side coupling pattern which is positioned to face the second power supply point-side coupling pattern in a laminating direction thereof and divided in a portion thereof by a fourth gap; and a second spiral antenna pattern having an approximately rectangular shape in a plan view, which is coupled to the portion divided by the fourth gap, the first power supply point-side coupling pattern and the second power supply point-side coupling pattern are positioned adjacent to each other on a first substrate surface, and arranged so as to be rotated on the first substrate surface by 180 degrees with respect to each other, the first antenna-side coupling pattern and the second antenna-side coupling pattern are positioned on a second substrate surface which faces the first substrate surface in a laminating direction thereof, and arranged so as to be rotated on the second substrate surface by 180 degrees with respect to each other, the first gap and the second gap are arranged so as to be rotated by 180 degrees with respect to each other, and the third gap and the fourth gap are arranged so as to be rotated by 180 degrees with respect to each other, and the first spiral antenna pattern and the second spiral antenna pattern are positioned adjacent to each other on the second substrate surface, and extending directions of end portions of the first and second spiral antenna patterns which are closest to each other on the second substrate surface are arranged so as to be rotated by 180 degrees with respect to each other.

2. The substrate antenna according to claim 1, wherein:

the first antenna-side coupling pattern has multiple structures being divided by the second gap, and the first spiral antenna pattern has multiple structures being circulated in a same direction so as to enclose the second gap, and the second antenna side coupling pattern has multiple structures being divided by the fourth gap, and the second spiral antenna pattern has multiple structures being circulated in a same direction so as to enclose the fourth gap.

3. The substrate antenna according to claim 1, further comprising:

a third antenna having a resonance frequency band different from said same resonance frequency band, the third antenna is disposed to face the first power supply point-side coupling pattern in a laminating direction thereof, and includes a loop-shaped third antenna-side coupling pattern which is divided in a portion thereof by a fifth gap and a third spiral antenna pattern which is coupled to the portion divided by the fifth gap, the third antenna-side coupling pattern and the third spiral antenna pattern are arranged on a first surface of a third substrate surface which faces the second substrate surface in a laminating direction thereof, respectively, and the fifth gap and the first gap are arranged so as to be rotated by 180 degrees with respect to each other.

4. The substrate antenna according to claim 3, wherein:

the first antenna-side coupling pattern has multiple structures being divided by the second gap, and the first spiral antenna pattern has multiple structures being circulated in a same direction so as to enclose the second gap, the second antenna-side coupling pattern has multiple structures being divided by the fourth gap, and the second spiral antenna pattern has multiple structures being circulated in a same direction so as to enclose the fourth gap, and the third antenna-side coupling pattern has multiple structures being divided by the fifth gap, and the third spiral antenna pattern has multiple structures being circulated in a same direction so as to enclose the fifth gap.

5. A substrate antenna for conducting signal transmitting/receiving using a first antenna and a second antenna having a same resonance frequency band: wherein the first antenna includes:

a loop-shaped first power supply point-side coupling pattern which is divided in a portion thereof by a first gap;

a loop-shaped first antenna-side coupling pattern which is positioned to face the first power supply point-side coupling patter in a laminating direction thereof and divided in a portion thereof by a second gap; and a first spiral antenna pattern having an approximately rectangular shape in a plan view, which is coupled to the portion divided by the second gap, the second antenna includes:

a loop-shaped second power supply point-side coupling pattern which is divided in a portion thereof by a third gap;

a loop-shaped second antenna-side coupling pattern which is positioned to face the second power supply point-side coupling pattern in a laminating direction thereof and divided in a portion thereof by a fourth gap; and a second spiral antenna pattern having an approximately rectangular shape in a plan view, which is coupled to the portion divided by the fourth gap, the first power supply point-side coupling pattern is positioned on a surface of a first substrate, the first antenna-side coupling pattern and the first spiral antenna pattern are positioned on another surface of the first substrate, the second power supply point-side coupling pattern is positioned on a surface of a second substrate which is disposed in parallel to the first substrate with a spacer made of a dielectric material interposed therebetween, and the second antenna-side coupling pattern and the second spiral antenna pattern are positioned on another surface of the second substrate, the first gap and the second gap are arranged so as to be rotated by 180 degrees with respect to each other, and the third gap and the fourth gap are arranged so as to be rotated by 180 degrees with respect to each other, and the first spiral antenna pattern and the second spiral antenna pattern are arranged so as to be rotated by 180 degrees with respect to each other in a manner where winding directions of spirals on the first spiral antenna pattern are different from each other.

* * * * *